United States Patent [19]

Harrison et al.

[11] Patent Number: 4,717,712

[45] Date of Patent: Jan. 5, 1988

[54] LUBRICANT SLIPPING LAYER FOR DYE-DONOR ELEMENT USED IN THERMAL DYE TRANSFER

[75] Inventors: Daniel J. Harrison; Noel R. Vanier, both of Rochester; Hsin-Chia Kan, Fairport, all of N.Y.

[73] Assignee: Eastman Kodak Company, Rochester, N.Y.

[21] Appl. No.: 925,948

[22] Filed: Nov. 3, 1986

Related U.S. Application Data

[63] Continuation-in-part of Ser. No. 813,215, Dec. 24, 1985, abandoned.

[51] Int. Cl.[4] ..... B41M 5/26

[52] U.S. Cl. ..... 503/227; 8/471; 427/146; 427/256; 428/195; 428/480; 428/483; 428/522; 428/913; 428/914; 430/945

[58] Field of Search ..... 8/470, 471; 346/227; 427/146, 256; 428/195, 207, 411.1, 480, 522, 913, 914, 341, 483; 430/945

[56] References Cited

U.S. PATENT DOCUMENTS

| | | | |
|---|---|---|---|
| 4,253,838 | 3/1981 | Mizuno et al. | 428/913 |
| 4,567,113 | 1/1986 | Ohtsu et al. | 428/480 |
| 4,572,860 | 2/1986 | Nakamura et al. | 8/471 |

FOREIGN PATENT DOCUMENTS

| | | | |
|---|---|---|---|
| 138483 | 4/1985 | European Pat. Off. | 346/227 |

*Primary Examiner*—Bruce H. Hess
*Attorney, Agent, or Firm*—Harold E. Cole

[57] ABSTRACT

A dye-donor element for thermal dye transfer comprising a support having on one side thereof a dye layer and on the other side a slipping layer consisting essentially of a lubricating material of a polyethylene glycol having a number average molecular weight of about 6000 or above or fatty acid esters of polyvinyl alcohol.

17 Claims, No Drawings

LUBRICANT SLIPPING LAYER FOR DYE-DONOR ELEMENT USED IN THERMAL DYE TRANSFER

This application is a continuation-in-part of U.S. application Ser. No. 813,215, filed Dec. 24, 1985, now abandoned.

This invention relates to dye-donor elements used in thermal dye transfer, and more particularly to the use of a certain slipping layer on the back side thereof to prevent chatter marks and tearing of the donor element during the printing operation.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

A problem has existed with the use of dye-donor elements for thermal dye-transfer printing because a thin support is required in order to provide effective heat transfer. For example, when a thin polyester film is employed, it softens when heated during the printing operation and then sticks to the thermal printing head. This causes intermittent rather than continuous transport across the thermal head.The dye transferred thus does not appear as a uniform area, but rather as a series of alternating light and dark bands (chatter marks). Sufficient friction is often created to tear the dye-donor element during printing. It would be desirable to eliminate such problems in order to have a commercially acceptable system.

European Patent Application No. 138,483 relates to dye-donor elements having a slipping layer on the back side thereof comprising a lubricant in a resin binder along with particulate material. The slipping layer has a rough surface due to the presence of the particulate material in order to prevent the dye-donor sheet from sticking to the thermal printing head. Such particulate material could have an abrading effect on the printing head, however, and is undesirable for that reason.

U.S. Pat. No. 4,567,113 relates to slipping layers including fatty acids and fatty alcohol derivatives. U.S. Pat. No. 4,572,860 relates to slipping layers comprising urethane or vinyl chloride resns or higher fatty acids. It would be desirable to find additional slipping layer materials having an improved performance.

Accordingly, this invention relates to a dye-donor element for thermal dye transfer comprising a support having on one side thereof a dye layer and on the other side a slipping layer consisting essentially of a lubricating material of a polyethylene glycol having a number average molecular weight of about 6000 or above or fatty acid esters of polyvinyl alcohol.

The polyethylene glycol useful in the invention having a number average molecular weight of about 6000 or above can be any of the materials available commercially, such as Carbowax 20M® polyethylene glycol (20,000 mw) (Union Carbide Corp.), or Eastman 15415 ® polyethylene glycol 8000 (mw 7000–9000) (Eastman Kodak Co.).

Any fatty acid esters of polyvinyl alcohol can be employed in the invention. There may be employed, for example,

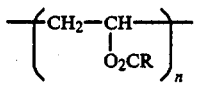

poly(vinyl octanoate) ($R{=}C_7H_{15}$), poly(vinyl pelargonate) ($R{=}C_8H_{17}$), poly(vinyl laurate) ($R{=}C_{11}H_{35}$) or poly(vinyl stearate) ($R{=}C_{17}H_{35}$). In a preferred embodiment of the invention, the lubricating material is poly(vinyl stearate). This material is available commercially from Polysciences Corp. (No. 3169).

The lubricant employed in the slipping layer of the invention can be employed in any amount which is effective for the intended purpose. In general, good results have been obtained at a coating coverage ranging from about 1 to about 2,000 mg/m$^2$.

Any dye can be used in the dye layer of the dye-donor element of the invention provided it is transferable to the dye-receiving layer by the action of heat. Especially good rsults have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

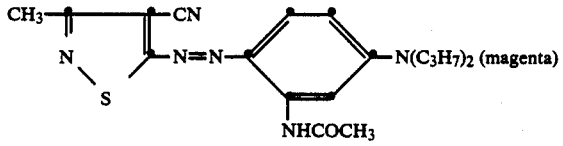

-continued

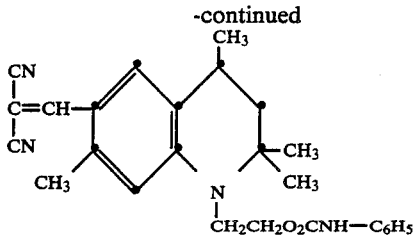

(yellow)

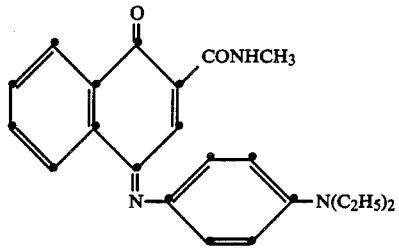

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 μm. It may also be coated with a subbing layer, if desired.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alchol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek®. In a preferred embodiment, polyester with a white pigment incorporated therein is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image and to a dye-receiving element to form the dye transfer image.

The dye-donor element of the invention may be used in sheet form or in a continuous roll or ribbon. If a continuous roll or ribbon is employed, it may have only one dye thereon or may have alternating stress of different dyes, such as sublimable cyan, magenta, yellow, black, etc., as described in U.S. Pat. No. 4,541,830. Thus one-, two- three- or four-color elements (or higher numbers also) are included within the scope of the invention.

In a preferred embodiment of the invention, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are availale commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

A magenta dye-donor element was prepared by coating the following layers in the order recited on a 6 μm poly(ethylene terephthalate) support:

(1) Dye barrier layer of gelatin nitrate (gelatin, cellulose nitrate and salicyclic acid in approximately 20:5:2 weight ratio in a solvent of acetone, methanol and water) (0.17 g/m$^2$), and (2) Dye layer containing the magenta dye described earlier (0.22 g/m$^2$), and cellulose acetate hydrogen phthalate (18–21% acetyl, 32–36% phthalyl) (0.39 g/m$^2$) coated from 8% cyclohexanone in 2-butanone.

A slipping layer was coated on the back of the dye-donor element having the lubricant indicated in Table 1 (0.86 g/m$^2$).

A dye-receiving element was prepared by coating 2.9 g/m$^2$ of Makrolon 5705 ® polycarbonate resin (Bayer A. G.) using a solvent mixture of dichloromethane and trichloroethylene or chlorobenzene on an ICI Melinex 990 ® white polyester support.

The dye side of each dye-donor element strip 0.75 inches (19 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a Fujitsu Thermal Head (FTP-040MCS001) and was pressed with a spring at a force of 3.5 pounds (1.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were heated at 0.5 msec increments from 0 to 4.5 msec to generate a graduated density test pattern. The voltage supplied to the print head was approximately 19 v representing approximately 1.75 watts/dot. Estimated head temperature was 250°–400° C.

Passage of the assemblage through the thermal head was evaluated. If no tearing was observed, the assemblage was separated, the dye-donor was discarded, and the dye transferred to the dye-receiver was evaluated visually. The following data were obtained:

TABLE 1

| Lubricant | Performance |
|---|---|
| Invention | |
| poly(vinyl stearate) (Polysciences Corp.) | G |
| Carbowax 20 M ® polyethylene glycol) (20,000 mw) (Union Carbide Corp.) | G |
| Eastman 15415 ® polyethylene glycol 8000 (mw 7000–9000) (Eastman Kodak Co.) | G |
| Controls | |
| Eastman 1305 ® beeswax (Eastman Kodak Co.) | P |
| Tone PCL-700 ® polycaprolactone (Union Carbide Corp.) | F |
| Eastman 15414 ® polyethylene glycol 1450 (Eastman Kodak Co.) | F |
| paraffin wax P21 ® (Fisher Scientific Co.) | T |
| Eastman 1306 ® Carnauba Wax (Eastman Kodak Co.) | P |
| hexacosane | P |
| octacosane | T |
| eicosane | T |
| stearic acid | F |
| Tergitol 15-S-30 ® | P |

TABLE 1-continued

| Lubricant | Performance |
|---|---|
| polyethylene-blocked polyethylene glycol (Union Carbide Corp.) | |

E — Excellent performance-smooth travel through head to produce a uniform record
G — Good performance-may stick slightly and occasionally on passage through head but produces a uniform record
F — Fair Performance-occasional sticking upon passage through head. Image shows density fluctuations
P — Poor performance or passage through head and image uniformity
T — Tears upon passage through head. No evaluation possible.

The above data show the unique ability of the lubricants employed in the slipping layer of the invention to promote smooth passage through the thermal head. The control materials either tore or gave only fair or poor performance.

EXAMPLE 2

A dye-donor element was prepared as in Example 1 except that the cyan dye described earlier was employed at 0.32 g/m$^2$. A slipping layer was coated on the back of the dye-donor element having the lubricant indicated in Table 2 (0.11 g/m$^2$).

A dye-receiving element was prepared as in Example 1.

The dye side of each dye-donor element strip 1 inch (25 mm) wide was placed in contact with the dye image-receiving layer of the dye-receiver element of the same width. The assemblage was fastened in the jaws of a stepper motor driven pulling device. The assemblage was laid on top of a 0.55 inch (14 mm) diameter rubber roller and a TDK Thermal Head (No. L-133) was pressed with a force of 8.0 pounds (3.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were pulse-heated from 0 up to 8.3 msec to generate a graduated density test pattern. The voltage supplied to the print head was approximately 22 v representing approximately 1.6 watts/dot (13 mjoules/dot) for maximum power to the 0.1 mm$^2$ area pixel.

Passage of the assemblage through the thermal head was evaluated as in Example 1. If no tearing was observed, the assemblage was separated, the dye-donor was discarded, and the dye transferred to the dye-receiver was evaluated visually. The following data were obtained:

TABLE 2

| Lubricant | Performance |
|---|---|
| Poly(vinyl octanoate) | G |
| Poly(vinyl pelargonate) | G |
| Poly(vinyl laurate) (Scientific Polymer Prod.) | G |
| Poly(vinyl stearate) (Polysciences Corp.) | G |
| None (control) | T |

The above data again show the unique ability of the lubricants employed in the slipping layer of the invention to promote smooth passage through the thermal head, in contrast to the control material which tore.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having on one side thereof a dye layer and on the other side a slipping layer, the improvement wherein said slipping layer consists essentially of a lubricating material of a polyethylene glycol having a number average molecular weight of about 6000 or above or fatty acid esters of polyvinyl alcohol.

2. The element of claim 1 wherein said lubricating material is present in an amount of from about 1 to about 2000 mg/m$^2$.

3. The element of claim 1 wherein said lubricating material is a fatty acid ester of polyvinyl alcohol comprising poly(vinyl octanoate), poly(vinyl pelargonate), poly(vinyl laurate) or poly(vinyl stearate).

4. The element of claim 1 wherein said lubricating material is a polyethylene glycol having a number average molecular weight of about 6000 or above.

5. The element of claim 1 wherein said support comprises poly(ethylene terephthalate) and said lubricating material is poly(vinyl stearate).

6. The element of claim 1 wherein said dye layer comprises sequential repeating areas of cyan, magenta and yellow dye.

7. In a process of forming a dye transfer image comprising (a) imagewise-heating a dye-donor element comprising a support having on one side thereof a dye layer and on the other side a slipping layer, and (b) transferring a dye image to a dye-receiving element to form said dye transfer image, the improvement wherein said slipping layer consists essentially of a lubricating material of a polyethylene glycol having a number average molecular weight of about 6000 or above or fatty acid esters of polyvinyl alcohol.

8. The process of claim 7 wherein said lubricating material is present in an amount of from about 1 to about 2000 mg/m$^2$.

9. The process of claim 7 wherein said lubricating material is a fatty acid ester of polyvinyl alcohol comprising poly(vinyl octanoate), poly(vinyl pelargonate), poly(vinyl laurate) or poly(vinyl stearate).

10. The element of claim 7 wherein said lubricaint material is a polyethylene glycol having a number average molecular weight of about 6000 or above.

11. The process of claim 7 wherein said support is poly(ethylene terephthalate) which is coated with sequential repeating areas of cyan, magenta and yellow dye, and said process steps are sequentially performed for each color to obtain a three-color dye transfer image.

12. In a thermal dye transfer assemblage comprising:

(a) a dye-donor element comprising a support having on one side thereof a dye layer and on the other side a slipping layer, and (b) a dye-receiving element comprising a support having thereon a dye image-receiving layer, said dye-receiving element being in a superposed relationship with said dye-donor element so that said dye layer is in contact with said dye image-receiving layer, the improvement wherein said slipping layer consists essentially of a lubricating material of a polyethylene glycol having a number average molecular weight of about 6000 or above or fatty acid esters of polyvinyl alcohol.

13. The assemblage of claim 12 wherein wherein said lubricating material is present in an amount of from about 1 to about 2000 mg/m$^2$.

14. The assemblage of claim 12 wherein said lubricating material is a fatty acid ester of polyvinyl alcohol comprising poly(vinyl octanoate), poly(vinyl pelargonate), poly(vinyl laurate) or poly(vinyl stearate).

15. The assemblage of claim 12 wherein said lubricating material is a polyethylene glycol having a number average molecular weight of about 6000 or above.

16. The assemblage of claim 12 wherein said support of the dye-donor element comprises poly(ethylene terephthalate) and said lubricating material is poly(vinyl stearate).

17. The assemblage of claim 12 wherein said dye layer comprises sequential repeating areas of cyan, magenta and yellow dye.

* * * * *